US005812151A

United States Patent [19]

Kishine et al.

[11] Patent Number: 5,812,151

[45] Date of Patent: Sep. 22, 1998

[54] PRINTING APPARATUS AND METHOD FOR PERFORMING A PRINTING OPERATION ON BOTH OBVERSE AND REVERSE SURFACES OF A CONTINUOUS WEB PAPER

[75] Inventors: Toshiaki Kishine, Chiba; Noritaka Yamaoka, Shiroi-machi, both of Japan

[73] Assignee: Miyakoshi Printing Machinery Co., Ltd., Chiba-ken, Japan

[21] Appl. No.: 636,141

[22] Filed: Apr. 22, 1996

[30] Foreign Application Priority Data

Mar. 14, 1996 [JP] Japan ..... 8-057153

[51] Int. Cl.[6] ..... B41J 3/60

[52] U.S. Cl. ..... 346/44; 101/424.1; 101/488; 346/136; 347/42; 347/102; 347/104; 427/466; 427/471

[58] Field of Search ..... 347/2, 42, 102, 347/104; 427/471, 209, 210, 466; 118/642, 643; 34/426; 101/424.1, 488; 346/44, 136; 355/24, 26

[56] References Cited

U.S. PATENT DOCUMENTS

| | | | |
|---|---|---|---|
| 4,609,279 | 9/1986 | Hausmann | 355/24 X |
| 5,179,417 | 1/1993 | Sugaya | 355/24 X |
| 5,376,957 | 12/1994 | Gandy | 347/3 |
| 5,526,748 | 6/1996 | Schleinz | 101/488 |

OTHER PUBLICATIONS

'87 Comprehensive Bibliography of Printing Machines; p. 198; Insatsu Shuppan Kenkyusho Co., Ltd.; Japan; Feb. 1987.

Pamphlet of "Automatic Offset Form Rotary Press"; Mac–System; Miyakoshi Printing Machinery Co., Ltd.; Japan; Mar. 1984.

*Primary Examiner*—Joseph W. Hartary

*Attorney, Agent, or Firm*—Frishauf, Holtz, Goodman, Langer & Chick

[57] ABSTRACT

In a printing apparatus for performing a printing operation on both obverse and reverse surfaces of a continuous web paper with an ink jet printing machine, there is a construction having a first printing unit for printing on one surface of the continuous web paper and a second printing unit for printing on the other surface of the continuous web paper, in which the first printing unit and the second printing unit are arranged at an identical position in respective paths of travel of a first portion and a second portion of the continuous web paper as oriented in parallel to each other, as facing downwards and as shifted to each other in the direction perpendicular to directions in which the first portion and the second portion of the continuous web paper are traveling, and the path of travel of the first portion of the continuous web paper which is printed by the first printing unit and the path of travel of the second portion of the continuous web paper which is printed by the second printing unit are made continuous via a turning unit for turning the continuous web paper at a right angle twice therein.

4 Claims, 8 Drawing Sheets

PRINTING APPARATUS AND METHOD FOR PERFORMING A PRINTING OPERATION ON BOTH OBVERSE AND REVERSE SURFACES OF A CONTINUOUS WEB PAPER

BACKGROUND OF THE INVENTION

1. Technical Field of the Invention

The present invention relates to a printing apparatus and method for performing, with an ink jet printing machine, a printing operation on both obverse and reverse surfaces of a continuous web paper which is traveling in a rotary press (hereinafter simply referred to as "a continuous web paper").

2. Description of the Prior Art

An ink jet printing machine, by the reason of its construction, can only be used in a state in which a printer head is oriented downwards.

As a consequence, when a continuous web paper is to be printed on both the obverse and reverse surfaces thereof with an ink jet printing machine in the prior art, it has been customary to employ one of two methods, i.e. a first printing method in which it is passed twice in the same printing machine and a second printing method in which a pair of printing units are employed.

In the above-mentioned first method in which a continuous web paper is passed twice in the same printing machine, the continuous web paper that has been introduced into the system is printed on one of the two surfaces thereof with an ink jet printing machine, it is then dried by a drying machine and thereafter it is wound onto a take-up unit. The continuous web paper so wound is again brought in a supplying section and, after it is turned from one surface to the other, the continuous web paper is fed into the ink jet printing machine which has printed on the above-mentioned one surface in order to print on the other surface of the continuous web paper.

On the other hand, in the above-mentioned second printing method in which a pair of printing units are employed, as shown in FIG. 1 of the accompanying drawings hereof, a first printing unit a and a second printing unit b are arranged at different locations in the path of travel of a continuous web paper c, in which the continuous web paper c is printed on one of the two surfaces thereof with the first printing unit a and is then passed through a drying machine d for drying thereof and thereafter the continuous web paper c is turned while it is being passed from the first printing unit a to the second printing unit b. Then, the continuous web paper is printed on the other of the two surfaces thereof with the second printing unit b, followed by drying thereof in the similar manner to the above at a separate drying machine e.

Of the above-mentioned two printing methods which have been used in the prior art, the method in which a continuous web paper is passed twice in an identical printing machine must involve a similar step that must be carried out twice and it has been found that this method is therefore very poor in its efficiency.

On the other hand, the method in which a pair of printing units are employed must involve the arrangement of two sets of a substantially identically constructed printing unit in the path of travel of a continuous web paper. Accordingly, it has been found that this method unavoidably requires a large-sized equipment and involves the problem that the equipment cost becomes expensive and a large space for equipping the printing apparatus becomes necessary.

SUMMARY OF THE INVENTION

The present invention is achieved to resolve the above-mentioned problems in the prior art. It is a first object of the present invention to provide a printing apparatus for performing a printing operation on both obverse and reverse surfaces of a continuous web paper, which can be small-sized by enabling the continuous web paper to be printed on both the obverse and reverse surfaces thereof in a single continuous path of travel of the continuous web paper. Accordingly, there can be reduced the space for equipping the printing apparatus and can be also reduced the cost of operation. It is a second object of the present invention to provide a method of operating a printing apparatus as set forth above, which enables the apparatus to be small-sized. And by employing it, there can be reduced the cost of operation in a manner as set forth above.

Further, it is a third object of the present invention to provide a printing apparatus for performing a printing operation on both obverse and reverse surfaces of a continuous web paper, as set forth above, in which when the continuous web paper is printed on one of the two surfaces thereof and then is printed on the other surface thereof, the tension acting on a first portion of the continuous web paper, which has a reverse surface, i.e. one surface facing upwards and a second portion of the continuous web paper, which has an obverse surface, i.e. the other surface facing upwards (hereinafter simply referred to as "a first portion and a second portion of the continuous web paper") is stabilized in a short period of time and at the same time a meandering of the continuous web paper and a failure in the printing aim can be prevented. It is a fourth object of the present invention to provide a method of operating a printing apparatus as set forth above whereby the tension acting on the overall continuous web paper can be stabilized in a short period of time.

In order to achieve the objects mentioned above, there is provided in accordance with the present invention, in a first aspect thereof, a printing apparatus for performing a printing operation on both obverse and reverse surfaces of a continuous web paper, which comprises: a printing section having a first printing unit for printing on one surface of the continuous web paper and a second printing unit for printing on the other surface of the continuous web paper; a drying section constituted by a drying machine for drying the continuous web paper which has been printed; and a turning unit for turning the continuous web paper from one surface to the other surface thereof or vice versa, in which the first printing unit and the second printing unit are located at an identical position in respective paths of travel of a first portion and a second portion of the continuous web paper which are printed by the first and second printing units, respectively, the first and second printing units being arranged in parallel to each other as facing downwards and as shifted to each other in the direction perpendicular to directions in which the first and second portions of the continuous web paper are traveling; and the path of travel of the first portion of the continuous web paper which is printed by the first printing unit and the path of travel of the second portion of the continuous web paper which is printed by the second printing unit are made continuous by making the continuous web paper travel through the turning unit which shifts its phase in the right-angled direction with respect to the direction of travel of the continuous web paper.

According to another feature in the first aspect of the present invention, there is provided a printing apparatus for performing a printing operation on both obverse and reverse surfaces of a continuous web paper, as set forth above, which further comprises: a guide roller assembly on which the first and second portions of the continuous web paper travel in parallel to each other, the guide roller assembly being disposed in each of the path of travel of the first portion of the continuous web paper which is printed by the first printing unit and the path of travel of the second portion of the continuous web paper which is printed by the second printing unit, in which the guide roller assembly is divided into a first guide roller for guiding the first portion of the continuous web paper that is printed by the first printing unit and a second guide roller for guiding the second portion of the continuous web paper that is printed by the second printing unit, the first and second guide rollers being separated from each other and being rotatably supported by a common supporting shaft.

The present invention also provides, in a second aspect thereof, a method of operating a printing apparatus for performing a printing operation on both obverse and reverse surfaces of a continuous web paper, which comprises: a printing section having a first printing unit for printing on one surface of the continuous web paper and a second printing unit for printing on the other surface of the continuous web paper; a drying section constituted by a drying machine for drying the continuous web paper which has been printed; and a turning unit for turning the continuous web paper from one surface to the other surface thereof or vice versa, in which the first printing unit and the second printing unit are located at an identical position in respective paths of travel of a first portion and a second portion of the continuous web paper which are printed by the first and second printing units, respectively, the first and second printing units being arranged in parallel to each other as facing downwards and as shifted to each other in the direction perpendicular to directions in which the first and second portions of the continuous web paper are traveling; and the path of travel of the first portion of the continuous web paper which is printed by the first printing unit and the path of travel of the second portion of the continuous web paper which is printed by the second printing unit are made continuous by making the continuous web paper travel through the turning unit which shifts its phase in the right-angled direction with respect to the direction of travel of the continuous web paper.

According to another feature in the second aspect of the present invention, there is provided a method of operating a printing apparatus for performing a printing operation on both obverse and reverse surfaces of a continuous web paper, as set forth above, which further comprises: a guide roller assembly on which the first and second portions of the continuous web paper travel in parallel to each other, the guide roller assembly being disposed in each of the path of travel of the first portion of the continuous web paper that is printed by the first printing unit and the path of travel of the second portion of the continuous web paper which is printed by the second printing unit, in which the guide roller assembly is divided into a first guide roller for guiding the first portion of the continuous web paper which is printed by the first printing unit and a second guide roller for guiding the second portion of the continuous web paper which is printed by the second printing unit, the first and second guide rollers being separated from each other and being rotatably supported by a common supporting shaft.

The present invention is also directed, in a third aspect thereof, to a product which is made according to a method as mentioned above.

The present invention that can be practiced in the aspects and with the features as set forth above provides a variety of unique advantages, some of which are mentioned below.

According to the present invention, by virtue of the fact that in a printing apparatus and method for performing a printing operation on both obverse and reverse surfaces of a continuous web paper 6 with an ink jet printing machine, ink jet printing machines $\mathbf{11}_1$, $\mathbf{11}_2$ for printing on one surface of the continuous web paper 6 and ink jet printing machines $\mathbf{12}_1$, $\mathbf{12}_2$ for printing on the other surface of the continuous web paper 6 are arranged at an identical position in respective paths of travel of a first portion and a second portion of the continuous web paper 6, it is possible to minimize the space which is required for the ink jet printing machine to print on both the obverse and reverse surfaces of the continuous web paper 6. Accordingly, since the space can be reduced to approximately one half of that which has hitherto been required for a conventional printing apparatus as shown in FIG. 1, the apparatus can be much small-sized and thus the space for equipping the printing apparatus can be reduced. As a consequence, a marked reduction in the costs of equipment and operation can be achieved.

And, it may be also noted that when two portions of the single continuous web paper 6, viz. comprising a first portion which is printed on one surface thereof by the first printing unit and a second portion which is printed on the other surface thereof by the second printing unit, are to travel on a guide roller assembly, an undivided guide roller assembly can be employed such that those two portions of the continuous web paper 6 can travel thereon in parallel to each other. By dividing, however, the above guide roller assembly into a first guide roller for guiding the first portion of the continuous web paper which is printed on one surface thereof and a second guide roller for guiding the second portion of the continuous web paper which is printed on the other surface thereof, the first guide roller and the second guide roller can be separated from each other and rotatably supported by a common supporting shaft. Accordingly it will be seen that when the continuous web paper is printed on one of the two surfaces thereof and then is printed on the other surface thereof, even if a difference in tension is produced between those two portions of the continuous web paper, such a difference of tensions on, or speeds of travel of, those two portions of the continuous web paper will be absorbed on each such roller assembly on which they travel, thus eliminating a possibility for the continuous web paper to be ill-balanced between those two portions in tension or speed of travel. As a result, there can be stabilized any variable tension acting on those portions of the continuous web paper in a short period of time whereas there can be prevented any possible meandering of the continuous web paper and any failure in the printing aim.

BRIEF DESCRIPTION OF THE DRAWINGS

These and other objects, features and advantages of the present invention will become more readily apparent from a reading of the following specific description thereof, reference being had to the accompanying drawings in which.

DESCRIPTION OF THE PREFERRED EMBODIMENTS

Figure 1:
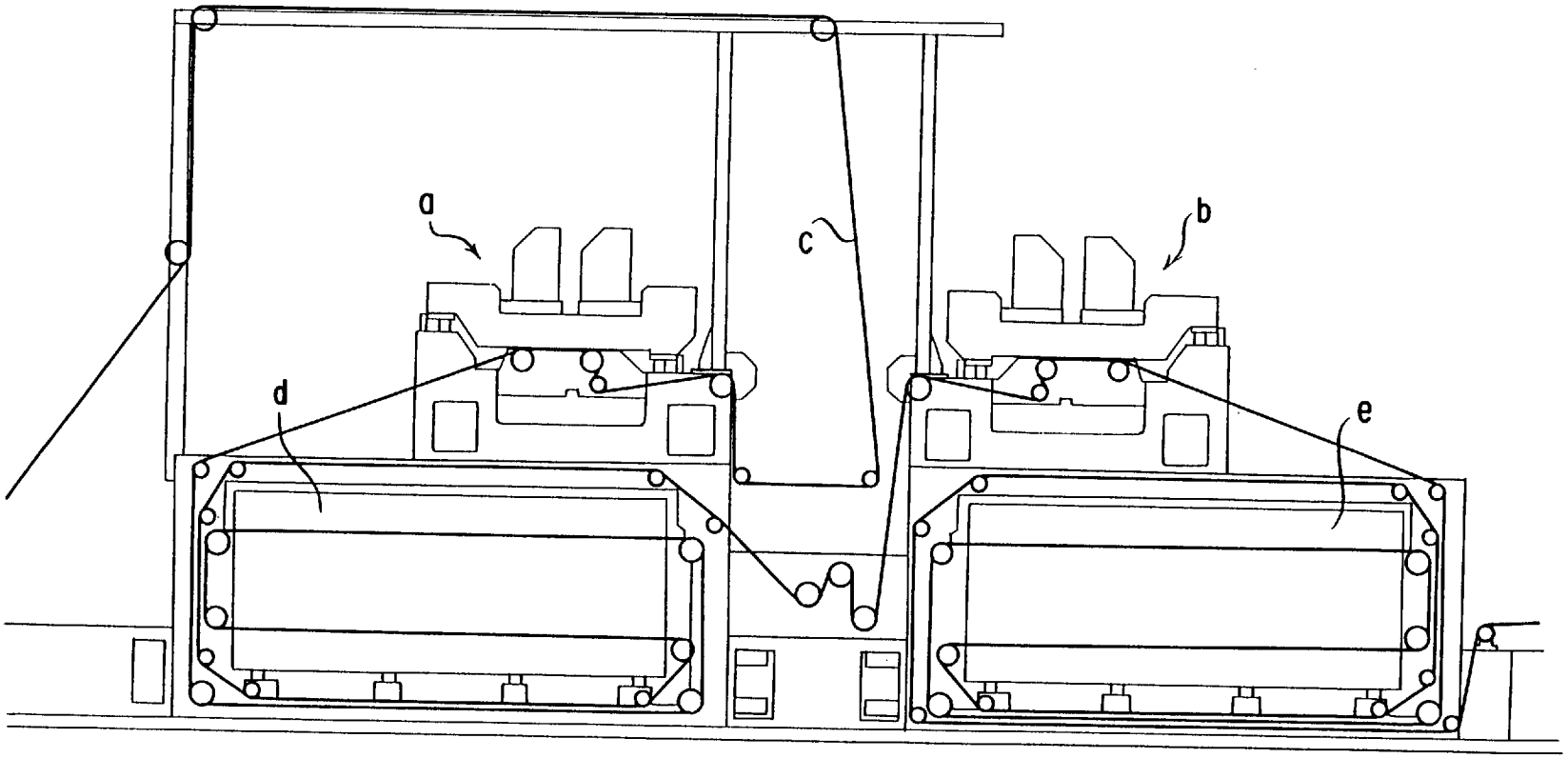
FIG. 1 (PRIOR ART)
FIG. 1 is a diagrammatic view schematically illustrating a conventional printing apparatus in its entirety.
Figure 2:
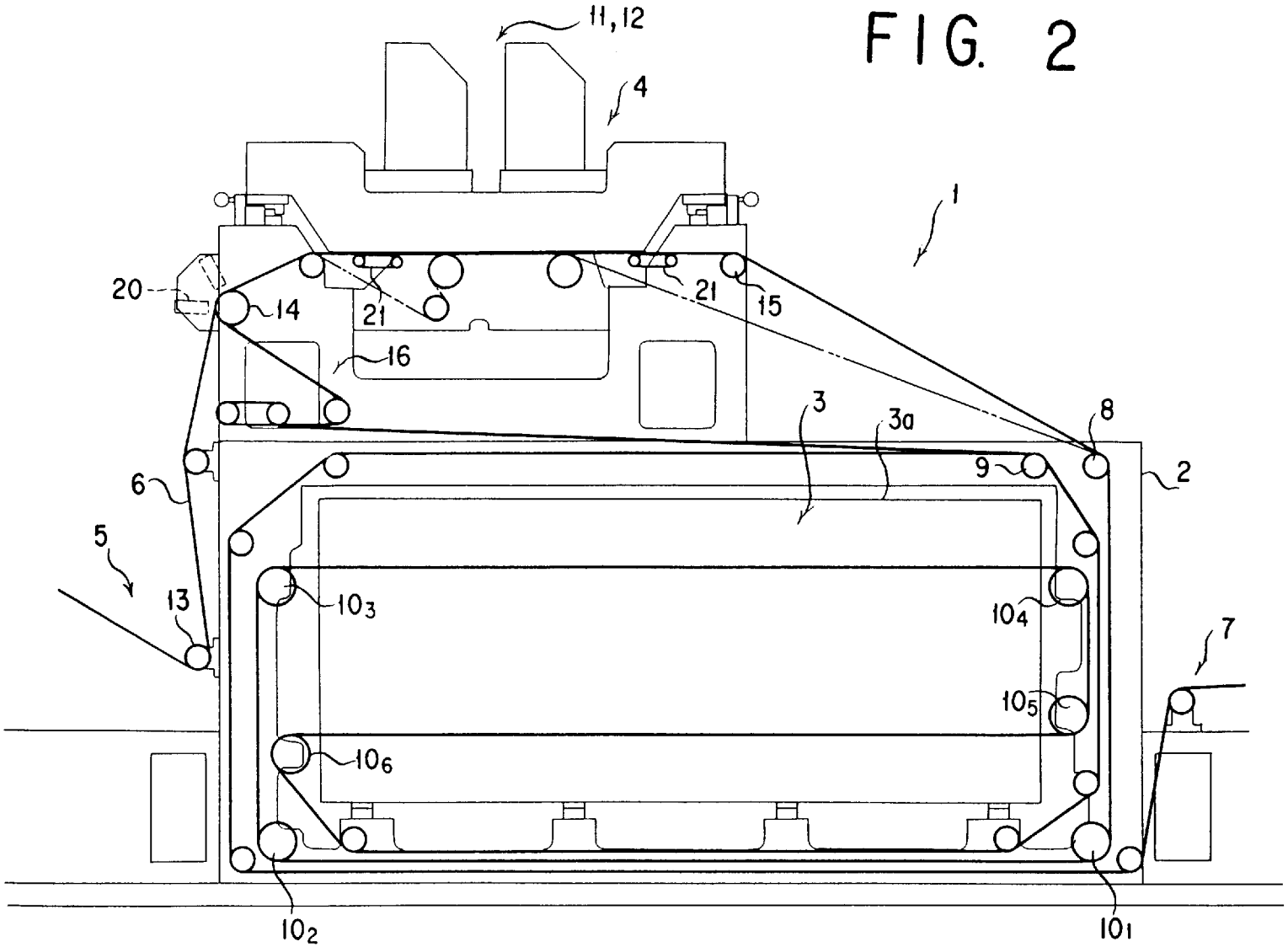
FIG. 2 is a front view schematically illustrating one embodiment according to the present invention in its entirety.

An explanation will be now given with respect to one embodiment according to the present invention with reference to FIG. 2 ff.

In the drawings, numeral 1 designates a printing apparatus for performing a printing operation on both obverse and reverse surfaces of a continuous web paper with an ink jet printing machine. The printing apparatus 1 includes a drying section 3 at a lower part of a machine frame 2 and a printing section 4 at an upper part thereof. The printing section 4 is so adapted as to stagger the time for the print of the reverse surface, i.e. one surface and then the obverse surface, i.e. the other surface of a continuous web paper 6 which has been supplied from a paper supply section 5 which is disposed on one side of the machine frame 2, i.e. on the left hand side thereof in this embodiment (a first time mark printing operation and a second time mark printing operation). The continuous web paper 6 which has been printed on the one surface thereof is transported into a drying section 3 where it is dried, whereafter the continuous web paper 6 which has been printed on the other surface thereof is transported into the drying section 3 where it is again dried. The continuous web paper 6 which has been printed on both the surfaces thereof and then dried is adapted to be discharged from a paper discharge section 7 which is disposed on the other side of the machine frame 2, i.e. on the right hand side thereof in this embodiment. The discharged paper is either wound around a take-up unit which is disposed on the downstream side of the discharge section 7 or is processed at a processing section of a folding machine or the like.

It should be noted here that the terms of "the obverse surface" and "the reverse surface" of the continuous web paper 6 in the embodiment according to the present invention simply mean nothing other than one surface and the other surface of the continuous web paper 6 and is not intended to represent a specific surface. In one example of the embodiment according to the present invention, however, note that it is assumed that the reverse surface, i.e. one surface of a continuous web paper is coated with a paste whereas the obverse surface, i.e. the other surface of the continuous web paper is not coated with such a paste. It should then be noted that the reverse surface which is coated with the paste will be first printed (i.e. a first time mark printing operation) and thereafter the obverse surface which is not pasted will be printed (i.e. a second time mark printing operation).

Figure 5:
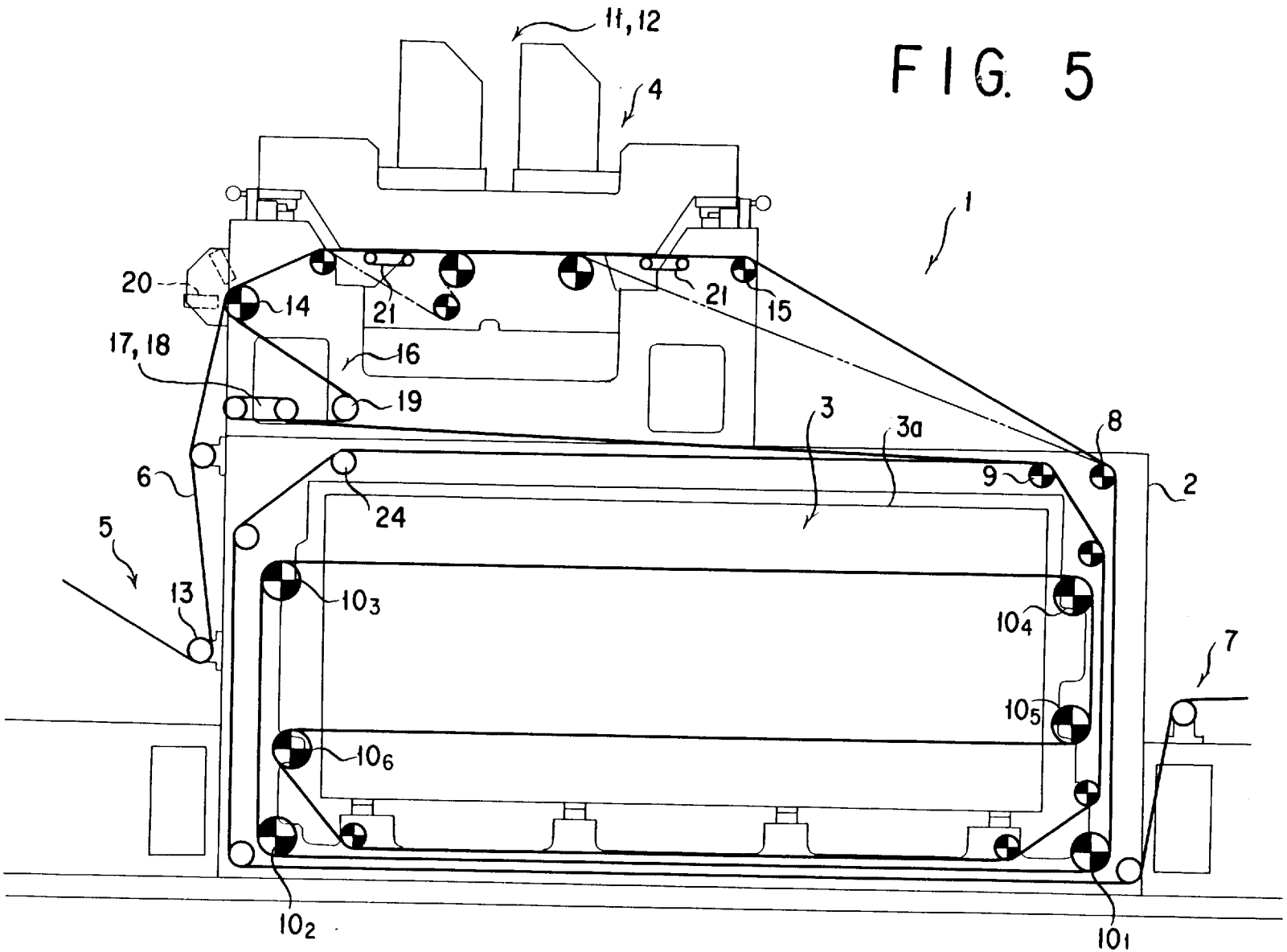
FIG. 5 is a front view schematically illustrating another embodiment in its entirety according to the present invention.
Figure 6:
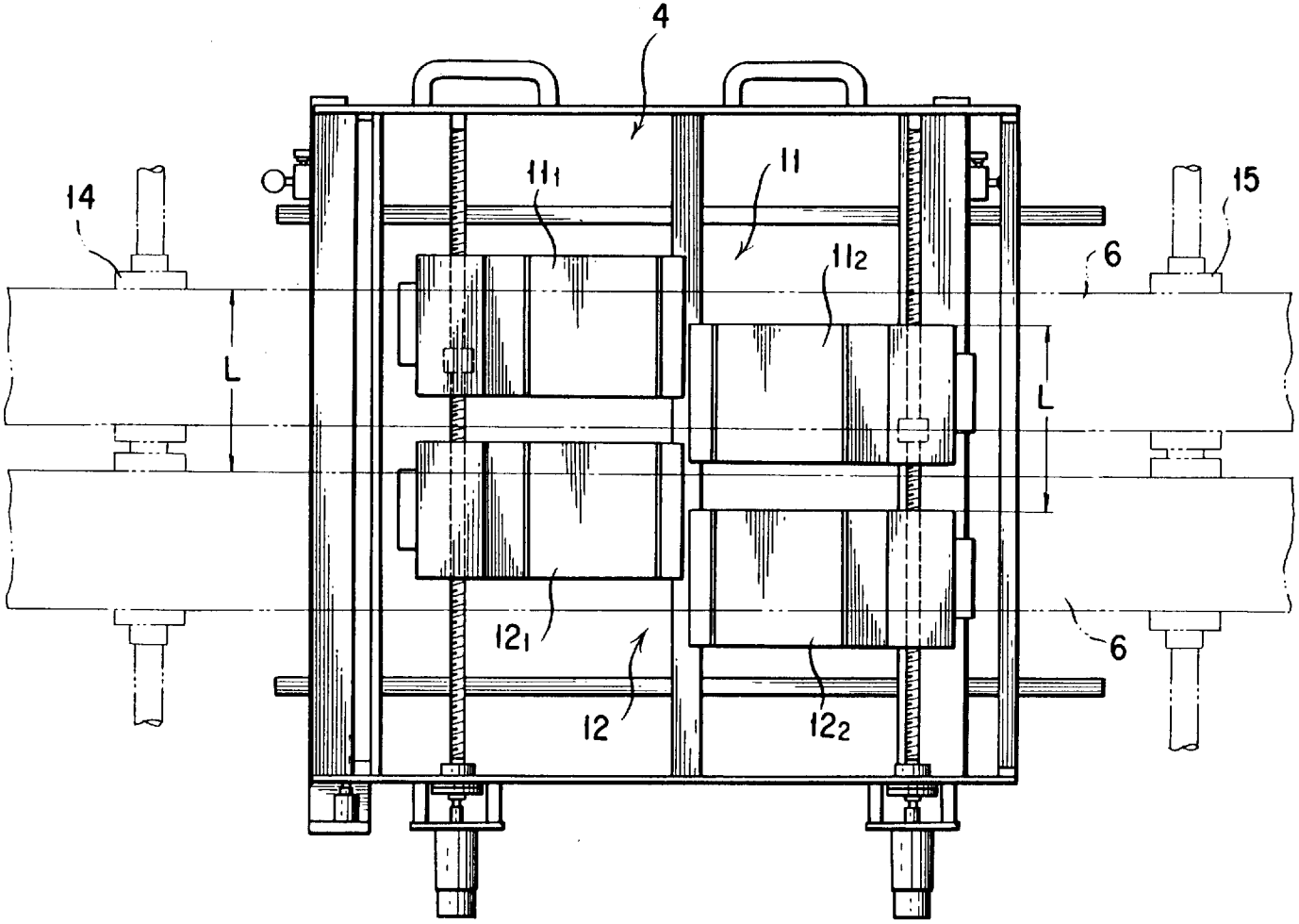
FIG. 6 is a top plan view illustrating in some details a printing section of the above-mentioned another embodiment.

As shown in FIGS. 2 and 5, it will be seen that the drying section 3 incorporates a drying machine 3*a* of a known design and is provided with a drying path that is sufficient in length to dry the continuous web paper 6 which has been printed at the printing section 4 therein. In the peripheral region of the drying machine 3*a*, there are provided an inlet roller 8 for guiding the continuous web paper 6 from the above-mentioned printing section 4 in the direction of the drying machine 3*a*, an outlet roller 9 for guiding the continuous web paper 6 from the drying machine 3*a* in the direction of the printing section 4, and a plurality of other guide rollers $\mathbf{10}_1$, $\mathbf{10}_2$, $\mathbf{10}_3$, . . . $\mathbf{10}_n$. In this connection it should be noted that the inlet roller 8 and the outlet roller 9 mentioned above are disposed at the upper part of the downstream side of the drying machine 3*a*.

Figure 3:
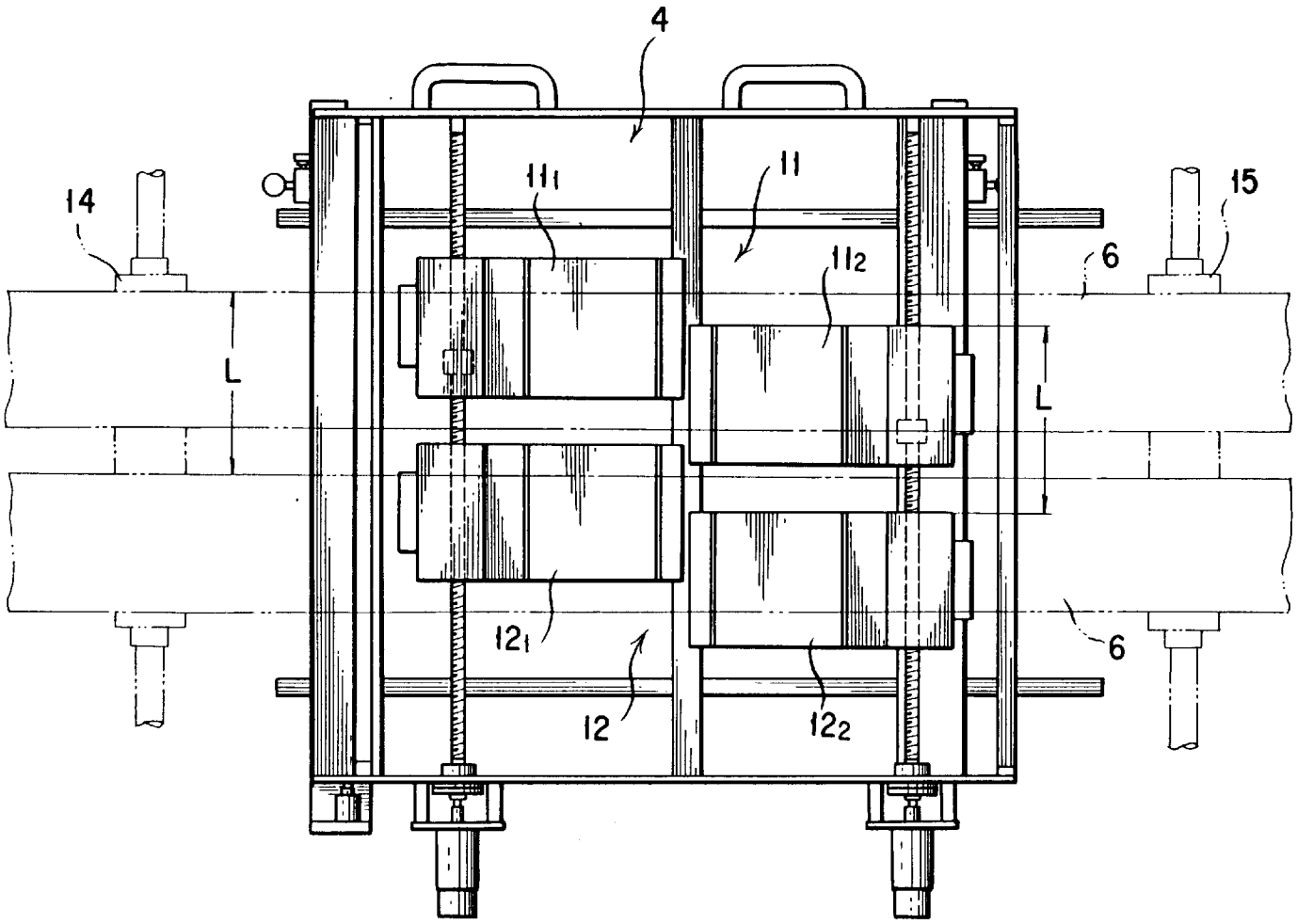
FIG. 3 is a top plan view illustrating in some details a printing section of the above-mentioned embodiment.

As can be seen from FIG. 3, the printing section 4 comprises a first printing unit 11 that is designed to print one surface of the continuous web paper 6 and a second printing unit 12 that is designed to print the other surface thereof, and is so constructed that the two printing units 11 and 12 may be disposed at an identical position in the traveling path of the continuous web paper 6 and arranged in parallel to each other while being shifted by a length L that is greater than the width of the continuous web paper 6 in the direction perpendicular to the direction of travel of the continuous web paper 6. The above-mentioned first printing unit 11 is provided with a pair of ink jet printing machines $\mathbf{11}_1$ and $\mathbf{11}_2$ whereas the above-mentioned second printing machine 12 is provided with a pair of ink jet printing machines $\mathbf{12}_1$ and $\mathbf{12}_2$. The ink jet printing machines $\mathbf{11}_1$ and $\mathbf{11}_2$ have their respective positions shifted in the direction of travel of the continuous web paper 6 and are used in a state in which each of their respective printer heads is facing downwards. The ink jet printing machines $\mathbf{12}_1$ and $\mathbf{12}_2$ are used in the same manner as the ink jet printing machines $\mathbf{11}_1$ and $\mathbf{11}_2$. In this connection, it should be noted that the positions of both printing units 11 and 12 are adjustable in the direction of the width of the continuous web paper 6.

On the upstream side of the printing section 4, it can be seen from FIGS. 2 and 5 that there are provided an inlet roller 14 for guiding the continuous web paper 6 transported from a paper supply roller 13 in the paper supply section 5, into the printing section 4. Also, on the downstream side of the printing section 4, it is seen that there is provided an outlet roller 15 for guiding the continuous web paper 6 towards the inlet roller 8 which transports the continuous web paper 6 into the drying section 3.

Figure 4:
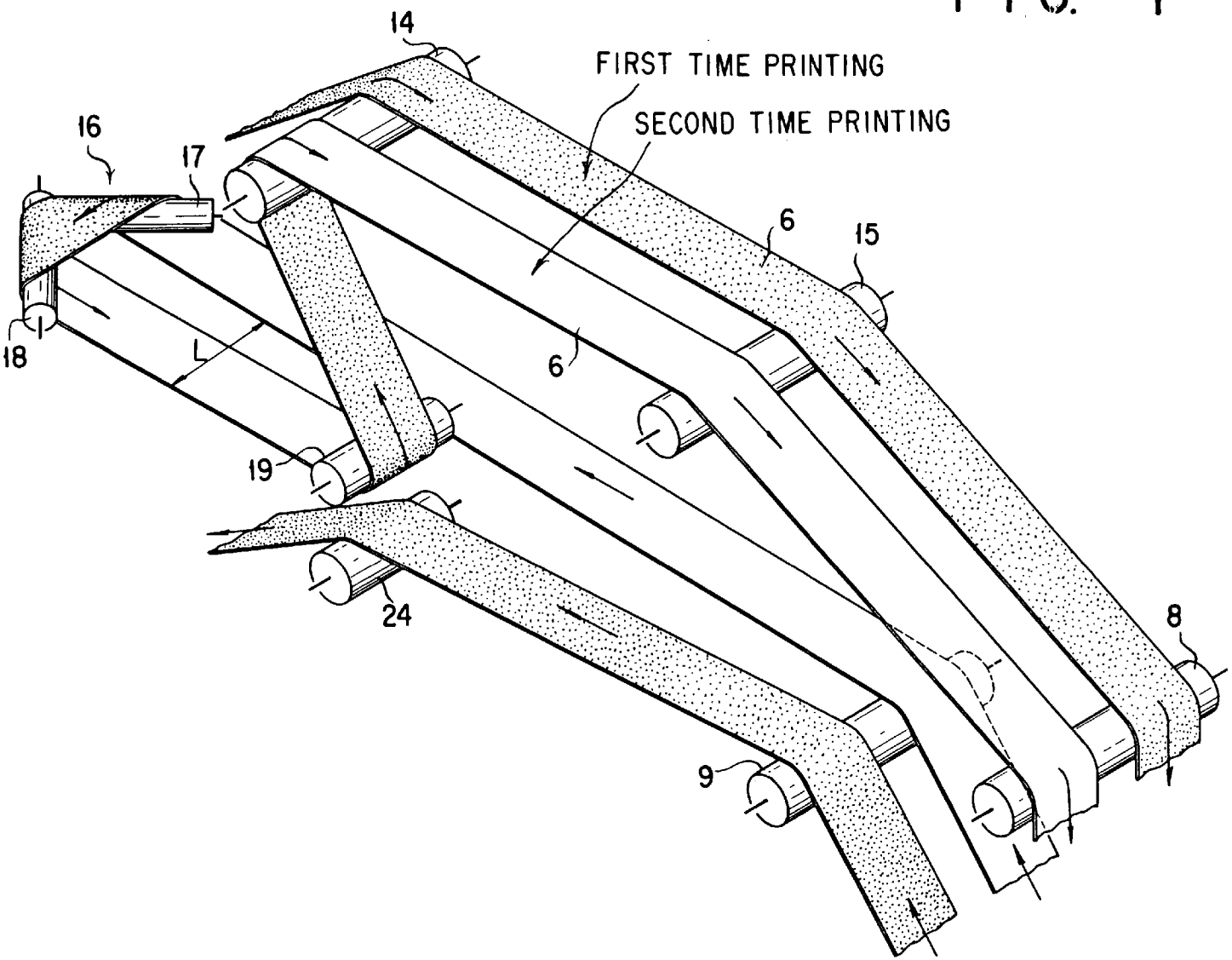
FIG. 4 is a diagrammatic view illustrating the construction and the operation of a turning unit of the above-mentioned embodiment.
Figure 7:
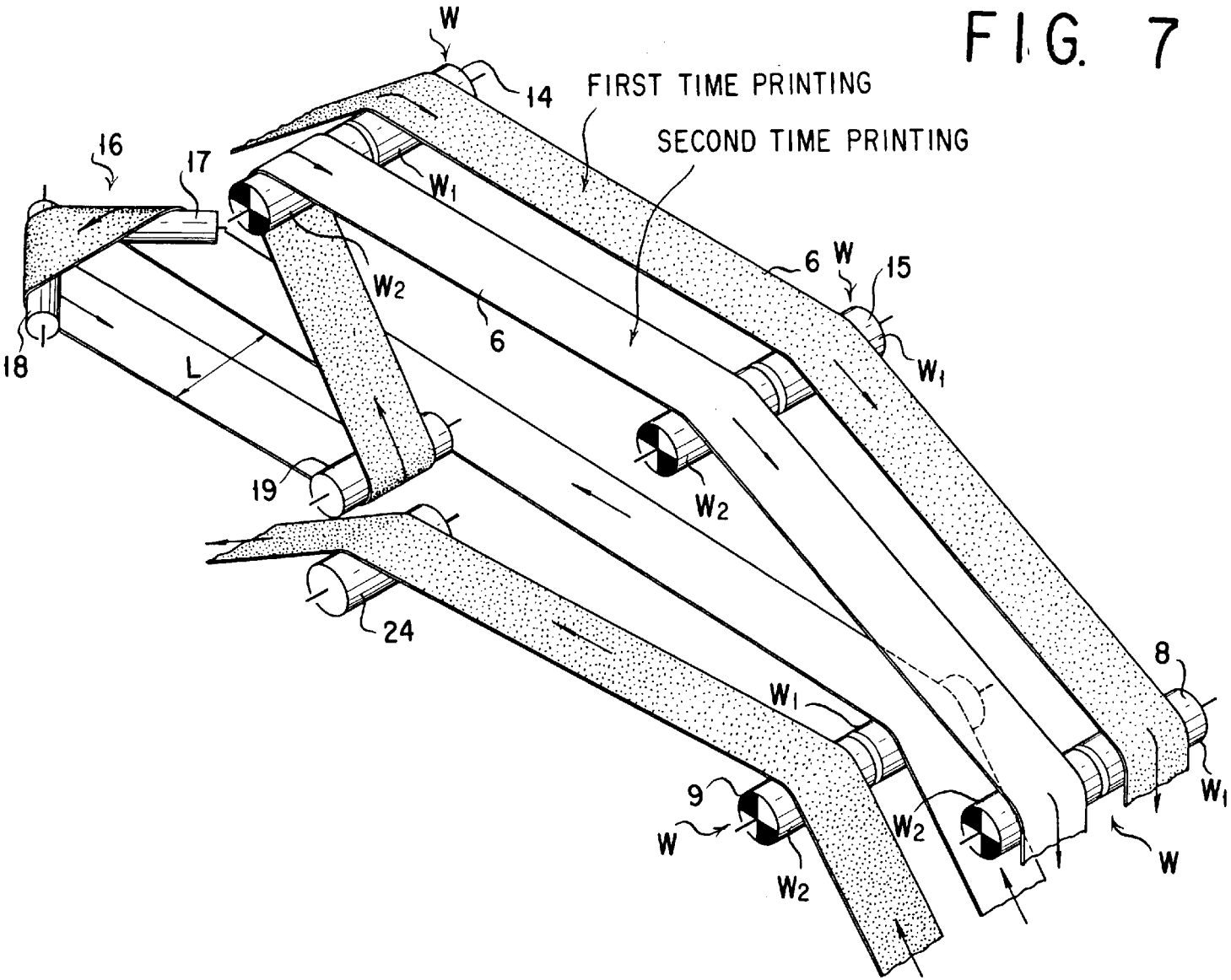
FIG. 7 is a diagrammatic view illustrating the construction and the operation of a turning unit of the above-mentioned another embodiment.

As shown in FIGS. 4 and 7, there is provided a turning unit 16 between the outlet roller 9 for feeding the continuous web paper 6 out of the drying machine 3*a* and the inlet roller 14 for feeding the continuous web paper 6 into the printing section 4. The turning unit 16 is constituted by a pair of turn bars 17 and 18 and a single guide roller 19. It can be seen that by being passed through the above-mentioned turning unit 16 via the outlet roller 9, the continuous web paper 6 fed out of the drying section 3 will be turned. More specifically, by passing the continuous web paper 6 through the turning unit 16, the continuous web paper that has been at first supplied from the paper supply section 5 will be turned from a state in which the reverse surface. (i.e. one surface) is facing upwards, that is, a state in which it is facing the printing section 4, into a state in which the obverse surface (i.e. the other surface) is facing upwards, that is, a state in which it is facing the printing section 4.

In connection with the above, it should be noted that the direction of travel of the continuous web paper 6 which has been fed out of the drying machine 3*a* and has traveled on the outlet roller 9 becomes opposite to the direction, i.e. the regular direction of travel of the continuous web paper supplied from the paper supply section 5, and the obverse surface, i.e. the other surface of the continuous web paper faces upwards. Therefore, if the continuous web paper 6 which has travel on the outlet roller 9 does not pass through the turning unit 16 but is fed into the printing section 4 via the inlet roller 14, would have the reverse surface, i.e. one surface will face upwards in the same way when the first time mark printing operation was carried out.

Further, as can be seen from FIGS. 4 and 7, the continuous web paper 6 will be transported back into the regular direction by means of the two turn bars 17 and 18 in the turning unit 16 in a state in which the continuous web paper is shifted towards this side by a length L which is greater than the width of the continuous web paper 6 while having the identical surface as it had, and will be guided onto the inlet roller 14 in the printing section 4. In this connection, it should be noted that in the present embodiment, the obverse surface of the continuous web paper 6 which is not coated with a paste will frictionally slide over the two turn bars 17 and 18.

While the continuous web paper 6 is fed via the inlet roller 14 into the printing section 4, there is provided a mark sensor 20 at a position where the mark sensor is opposed to the inlet roller 14 as shown in FIGS. 2 and 5. When the continuous web paper 6 is passed over the inlet roller 14, it is therefore apparent that a mark which has been preliminary printed on the continuous web paper will be read out by the mark sensor 20.

Also, it is seen that the printing section 4 is provided with a pair of pin tractors 21 which transport the continuous web paper 6 with taking a timing. The above-mentioned pin tractors are employed when the continuous web paper 6 is formed with feed pin holes. In case that the continuous web paper 6 is not formed with such feed pin holes, however, a timing of its travel will be taken by any other suitable means.

With respect to a variety of rollers for guiding the above-mentioned continuous web paper 6, it should be noted that they are classified into an inlet roller 14 for feeding the continuous web paper 6 into the printing section 4, an outlet roller 15 for feeding the continuous web paper 6 out of the printing section 4, a plurality of guide rollers interposed between the inlet roller 14 and the outlet roller 15, an inlet roller 8 for feeding the continuous web paper 6 into the drying machine 3*a*, an outlet roller 9 for feeding the continuous web paper 6 out of the drying machine 3*a* and a plurality of guide rollers $\mathbf{10}_1$, $\mathbf{10}_2$, $\mathbf{10}_3$, . . . $\mathbf{10}_n$ which are interposed between the inlet roller 8 and the outlet roller 9. The above rollers are so constructed that the first and second portions of the continuous web paper 6 may be traveling on those rollers in parallel to each other. These rollers are used as guide rollers for guiding the first portion and the second portion of the continuous web paper 6 in parallel to each other so that they may travel in the identical direction in a state in which the continuous web paper 6 has been turned by passing through the above-mentioned turning unit 16 and a phase thereof has been shifted towards this side by a length L which is greater than the width of the continuous web paper 6. Here, when the first portion and the second portion of the continuous web paper 6 travel on the guide rollers in parallel to each other, it will be seen that, as shown in FIG. 4, the first portion and the second portion of the continuous web paper 6 may be guided over the undivided guide rollers. Further, as shown in FIG. 7, it is also possible to construct the guide rollers in such a manner that the first portion of the continuous web paper 6 which is printed on one surface thereof and the second portion of the continuous web paper 6 which is printed on the other surface thereof may travel on the guide rollers which are divided into two parts, respectively, which are supported rotatably by common supporting shafts.

Figure 8:
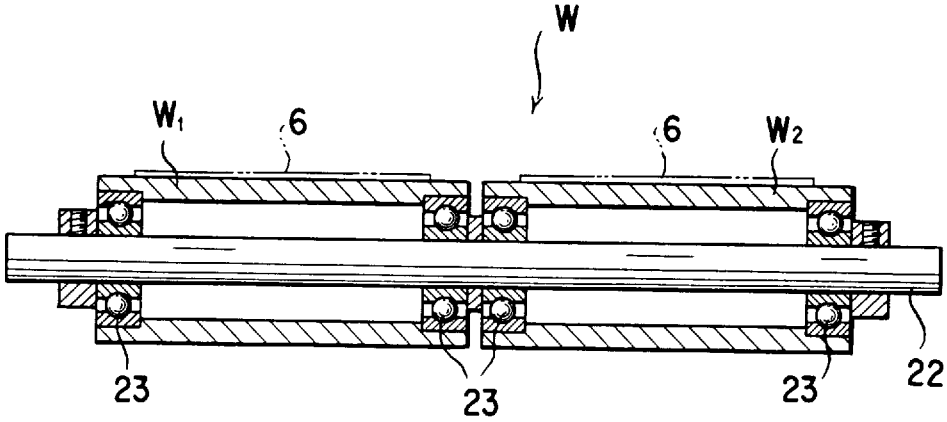
FIG. 8 is a cross sectional view illustrating in some details a roller assembly on which a first portion and a second portion of a continuous web paper travel in parallel to each other in the above-mentioned another embodiment.

Here, also, in regard of the guide rollers which are divided into the two separate rollers as mentioned above, FIG. 8 indicates that a guide roller assembly W on which the first portion and the second portion of the continuous web paper 6 travel in parallel to each other can be divided into a first guide roller $W_1$ for guiding the first portion of the continuous web paper 6 which is printed on one surface thereof and a second guide roller $W_2$ for guiding the second portion of the continuous web paper 6 which is printed on the other surface thereof, symmetrically in the direction of the axis of a common supporting shaft 22. The independent guide roller $W_1$ and guide roller $W_2$ are rotatably supported by the supporting shaft 22 via two sets of bearings 23 and 23, respectively. In this connection, it should be noted that the guide roller $W_1$ and the guide roller $W_2$ have a sufficient width for properly guiding the first and second portions of the continuous web paper 6. Note also that the above-mentioned two divided guide roller assembly W is disposed at each of the positions where the black cross marks are assigned in FIGS. 5 and 7.

An explanation will be now given below with respect to the operation of the printing apparatus for performing a printing operation on both obverse and reverse surface of a continuous web paper with an ink jet printing machine, which is constructed as mentioned above.

A continuous web paper 6 which has been preliminary printed in a given pattern in a separate printing course of operation will be supplied from the paper supply section 5 and fed via the paper supply roller 13 and the inlet roller 14 onto the above-mentioned first printing unit 11 in the printing section 4, for example, in which the reverse surface, i.e. one surface thereof that is coated with a paste is facing upwards. The continuous web paper 6 will then be printed with a pair of ink jet printing machines $\mathbf{11}_1$ and $\mathbf{11}_2$ which are operated in response to a detection signal that is furnished from the mark sensor 20 in the first printing unit 11, that is, the first time mark printing operation is carried out.

Then, the continuous web paper 6 that has been printed on the reverse surface, i.e. one surface will be fed out of the outlet roller 15 and transported via the inlet roller 8 and the other guide rollers $\mathbf{10}_1$, $\mathbf{10}_2$, $\mathbf{10}_3$, . . . $\mathbf{10}_n$ into the drying machine 3*a* and dried by passing therethrough.

Subsequently, the continuous web paper 6 which has been dried will be fed out of the drying machine 3*a* and will be fed into the turning unit 16 via the outlet roller 9. At this point, it should be noted that the turning unit 16 will act to turn the continuous web paper 6 at a right angle twice therein and thus turn the continuous web paper 6 from one surface to the other surface thereof or vice versa. Then the continuous web paper 6 that has been turned in the turning unit 16 will be fed via the inlet roller 14 into the second printing unit 12 in the printing section 4. Here, a predetermined printing operation will be carried out on the obverse surface, i.e. the other surface of the continuous web paper 6 by means of the ink jet printing machines $\mathbf{12}_1$, $\mathbf{12}_2$. At this time, a timing will be taken in response to a detection signal that is furnished from the mark sensor 20 to perform the printing operation, that is, the second time printing operation is carried out.

Then, the continuous web paper 6 which has been printed on the obverse surface, i.e. the other surface thereof Will be again fed via the outlet roller 15 and the inlet roller 8 into the drying machine 3*a* and dried by passing therethrough. And, the continuous web paper 6 which has been printed on both of the obverse and reverse surfaces thereof will be transported into the discharge path via a discharge roller 24 disposed on this side of the turning unit 16, travel towards the discharge section 7, and then be discharged therefrom.

In connection with the preceding description, it should be noted here that owing to the fact that the turning unit 16 having a turn bar resistance is interposed between the first path of travel of the continuous web paper which is printed on one surface thereof and the second path of travel of the continuous web paper which is printed on the other surface thereof, a difference in tension will be produced between the first portion of the continuous web paper traveling through the first path and the second portion of the continuous web paper traveling through the second path, and thus there is partially produced difference between the respective speeds of travel of the first portion and the second portion of the continuous web paper traveling through the first and second paths, respectively.

With respect to each roller assembly W which is disposed in each of the printing section 4 and the drying machine 3*a*, and on which the two portions of the continuous web paper travel in parallel to each other, however, since it is divided into a first guide roller $W_1$ for guiding the first portion of the continuous web paper 6 for printing on one surface thereof and a second guide roller $W_2$ for guiding the second portion of the continuous web paper 6 for printing on the other surface thereof and the divided guide rollers $W_1$ and $W_2$ are independently rotated to each other, even if there exists such a difference in tension, the first and second portions of the continuous web paper 6 will be guided by the two separate rollers, respectively, and travel without any interference arising from the difference in tension.

As a result, no action will develop here, whereby the continuous web paper for printing on one surface thereof and the continuous web paper for printing on the other surface thereof could interfere with each other to mutually destroy a balance between their respective tensions or between their respective speeds of travel. Thus, the tension over the entire continuous web paper will be stabilized in a short period of time.

While the present invention has hereinbefore been described with respect to certain illustrative embodiments thereof, it will be readily appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A printing apparatus for performing a printing operation on both obverse and reverse surfaces of a continuous web paper, comprising:

a printing section having a first printing unit for printing on one surface of said continuous web paper and a second printing unit for printing on the other surface of said continuous web paper;

a drying section constituted by a drying machine for drying said continuous web paper which has been printed; and a turning unit for turning said continuous web paper from one surface to the other surface thereof or vice versa, characterized in that said first printing unit and said second printing unit are located at an identical position in respective paths of travel of a first portion and a second portion of the continuous web paper which are printed by said first and second printing units, respectively, said first and second printing units being arranged in parallel to each other as facing downwards and as shifted to each other in the direction perpendicular to directions in which said first and second portions of said continuous web paper are traveling; and said path of travel of said first portion of the continuous web paper that is printed by said first printing unit and said path of travel of said second portion of the continuous web paper that is printed by said second printing unit are made continuous by making said continuous web paper travel through said turning unit which shifts its phase in the right-angled direction with respect to the direction of travel of said continuous web paper.

2. A printing apparatus for performing a printing operation on both obverse and reverse surfaces of a continuous web paper, as set forth in claim 1, further comprising:

a guide roller assembly on which said first and second portions of the continuous web paper travel in parallel to each other, said guide roller assembly being disposed in each of said path of travel of said first portion of the continuous web paper which is printed by said first printing unit and said path of travel of said second portion of the continuous web paper which is printed by said second printing unit, characterized in that:

said guide roller assembly is divided into a first guide roller for guiding said first portion of the continuous web paper that is printed by said first printing unit and a second guide roller for guiding said second portion of the continuous web paper which is printed by said second printing unit, said first and second guide rollers being separated from each other and being rotatably supported by a common supporting shaft.

3. A method of operating a printing apparatus for performing a printing operation on both obverse and reverse surfaces of a continuous web paper, said apparatus comprising:

a printing section having a first printing unit for printing on one surface of said continuous web paper and a second printing unit for printing on the other surface of said continuous web paper;

a drying section constituted by a drying machine for drying said continuous web paper which has been printed; and a turning unit for turning said continuous web paper from one surface to the other surface thereof or vice versa, said method being characterized in that:

said first printing unit and said second printing unit are located at an identical position in respective paths of travel of a first portion and a second portion of the continuous web paper which are printed by said first and second printing units, respectively, said first and second printing units being arranged in parallel to each other as facing downwards and as shifted to each other in the direction perpendicular to directions in which said first and second portions of said continuous web paper are traveling; and said path of travel of said first portion of the continuous web paper that is printed by said first printing unit and said path of travel of said second portion of the continuous web paper that is printed by said second printing unit are made continuous by making said continuous web paper travel through said turning unit which shifts its phase in the right-angled direction with respect to the direction of travel of said continuous web paper.

4. A method of operating a printing apparatus for performing a printing operation on both obverse and reverse surfaces of a continuous web paper, as set forth in claim 3, said apparatus further comprising:

a guide roller assembly on which said first and second portions of the continuous web paper travel in parallel to each other, said guide roller assembly being disposed in each of said path of travel of said first portion of the continuous web paper which is printed by said first printing unit and said path of travel of said second portion of the continuous web paper which is printed by said second printing unit, said method being characterized in that:

said guide roller assembly is divided into a first guide roller for guiding said first portion of the continuous web paper which is printed by said first printing unit and a second guide roller for guiding said second portion of the continuous web paper which is printed by said second printing unit, said first and second guide rollers being separated from each other and being rotatably supported by a common supporting shaft.

* * * * *